US006624581B1

(12) United States Patent
Daub et al.

(10) Patent No.: US 6,624,581 B1
(45) Date of Patent: Sep. 23, 2003

(54) CIRCUIT FOR DRIVING AN ALTERNATING CURRENT HIGH PRESSURE GAS DISCHARGE LAMP FOR A MOTOR VEHICLE

(75) Inventors: Wolfgang Daub, Anroechte (DE); Hans-Michael Helle, Lippstadt (DE); Stefan Moeller, Lippstadt (DE)

(73) Assignee: Hella KG Hueck & Co., Lippstadt (DE)

( * ) Notice: Subject to any disclaimer, the term of this patent is extended or adjusted under 35 U.S.C. 154(b) by 265 days.

(21) Appl. No.: 09/708,683

(22) Filed: Nov. 9, 2000

(30) Foreign Application Priority Data

Nov. 12, 1999 (DE) ..... 199 54 489

(51) Int. Cl.[7] ..... H01J 13/46; F21K 29/00
(52) U.S. Cl. ..... 315/58; 362/265
(58) Field of Search ..... 315/56, 58, 61, 315/77, 80, 209 CD, 209 M; 362/263, 265

(56) References Cited

U.S. PATENT DOCUMENTS

| | | | | |
|---|---|---|---|---|
| 4,467,247 A | * | 8/1984 | Hammer | 315/189 |
| 5,691,577 A | * | 11/1997 | Smith | 307/105 |
| 5,838,109 A | * | 11/1998 | Kobayashi et al. | 315/58 |
| 6,111,359 A | * | 8/2000 | Work et al. | 315/56 |

FOREIGN PATENT DOCUMENTS

| | | |
|---|---|---|
| DE | 910 | 8/1952 |
| DE | 4400412 A1 | 7/1994 |
| DE | 4310307 A1 | 10/1994 |
| DE | 19924097 A1 | 11/2000 |

* cited by examiner

*Primary Examiner*—Don Wong
*Assistant Examiner*—Minh D A
(74) *Attorney, Agent, or Firm*—Birch, Stewart, Kolasch & Birch, LLP

(57) ABSTRACT

A circuit for operating an alternating current high pressure gas discharge lamp for a motor vehicle is described. The circuit includes a ballast, a superimposed pulse starter, a symmetrical lamp filter and a high pressure gas discharge lamp which is surrounded at least partially by a reflector, the symmetrical lamp filter being arranged between the high pressure gas discharge lamp and the superimposed pulse starter, with a filter capacitor arranged in parallel with the high pressure gas discharge lamp and with one reactance coil arranged in each of the connecting lines between this parallel circuit and the starter circuit, and with two lamp power supply lines at the input of the starter circuit, a capacitor being arranged between the reflector and at least one of the lamp power supply lines. This causes the interference emitted by the high pressure gas discharge lamp to be diverted into the starter, thus preventing the interference pulses from being applied to the vehicle ground and thus to the vehicle electric system.

4 Claims, 1 Drawing Sheet

CIRCUIT FOR DRIVING AN ALTERNATING CURRENT HIGH PRESSURE GAS DISCHARGE LAMP FOR A MOTOR VEHICLE

This nonprovisional application claims priority under 35 U.S.C. §119(a) from German Patent Application No. 199 54 489.1 filed in Germany on Nov. 12, 1999, which is herein incorporated by reference.

BACKGROUND OF THE INVENTION

1. Field of the Invention

The present invention relates to a circuit for operating an alternating current high pressure gas discharge lamp for a motor vehicle, having a ballast, a starter, a symmetrical lamp filter and a high pressure gas discharge lamp at least partially surrounded by a reflector, the symmetrical lamp filter being arranged between the high pressure gas discharge lamp and the starter circuit, having a filter capacitor arranged in parallel with the high pressure gas discharge lamp and a reactance coil in the connecting lines between this parallel circuit and the starter circuit, and having two lamp power supply lines at the input of the starter circuit.

2. Description of the Background Art

The high pressure gas discharge lamps usually used in motor vehicles, namely D1 and D2 lamps, have an asymmetrical design with regard to their power supply connections. The feedback line together with the reflector forms a capacitance of approx. 2 to 3 pF; the reflector forms an equally large capacitance with the vehicle. Interference pulses on the feedback line are thus fed as capacitance into the vehicle electric system by way of the vehicle chassis and are difficult to filter out in the starter.

SUMMARY OF THE INVENTION

It is therefore an object of the present invention to prevent interference pulses from being fed into the vehicle chassis and the vehicle electric system.

This object is achieved according to the invention by arranging a capacitor between the reflector and one of the lamp power supply lines.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawing which is given by way of illustration only, and thus, is not limitive of the present invention, and wherein.

DETAILED DESCRIPTION OF THE PREFERRED EMBODIMENTS

Figure 1:
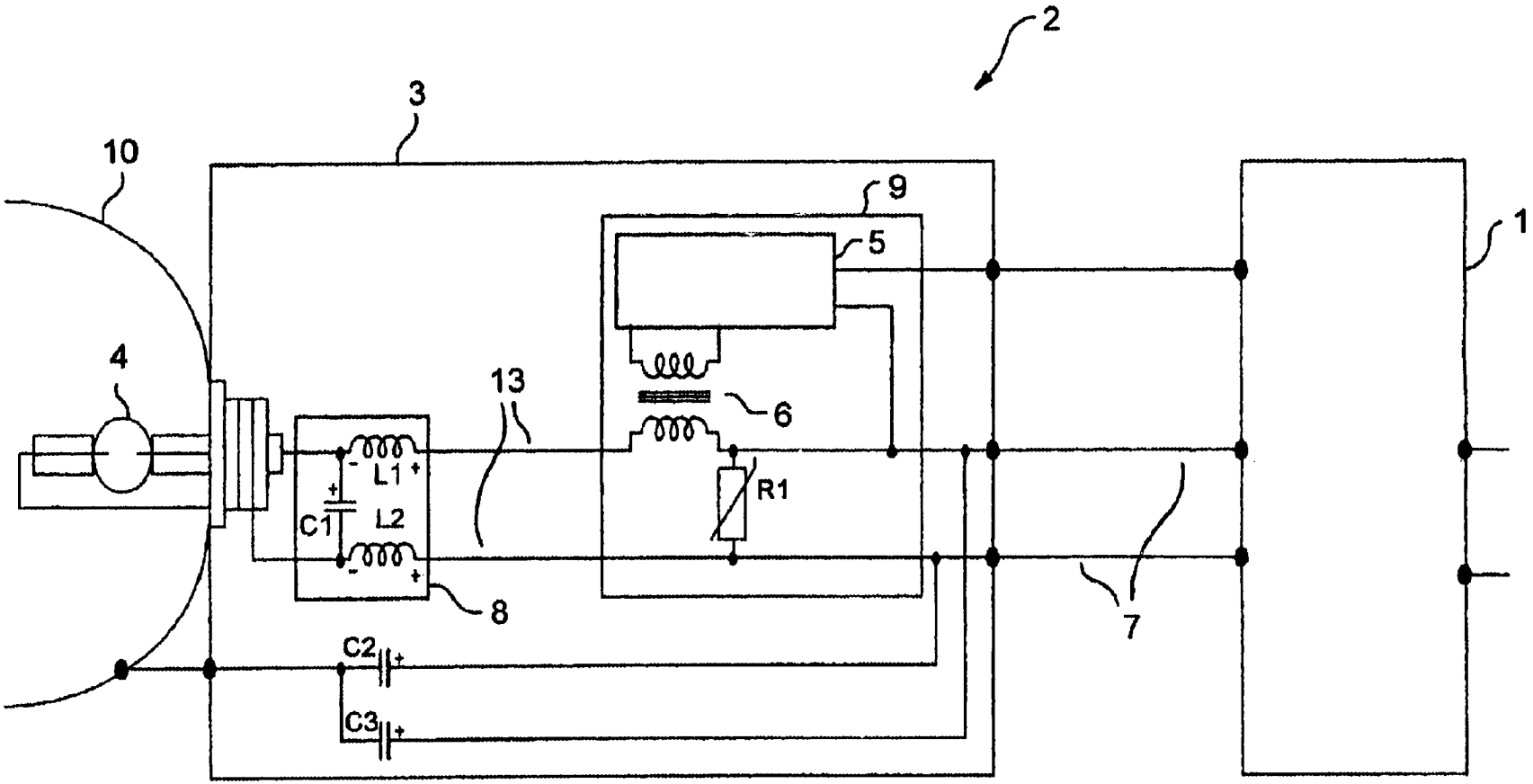
FIG. 1 is a circuit diagram according to the present invention.

One embodiment of the circuit according to the present invention is explained in greater detail below on the basis of FIG. 1. FIG. 1 illustrates a power supply unit 1 for a high pressure gas discharge lamp 2 and a starter 3 having an integrated lamp filter. The power supply unit 1 controls and supplies power to the high pressure gas discharge lamp (GDL) 4 as well as to the primary ignition circuit 5 of the starter 3. The starter 3 is designed as an asymmetrical superimposed pulse starter 9; for this purpose, a secondary winding of the ignition transformer (ZTR) 6 is connected to one of the lamp power supply lines 7. The starter 3 also has a symmetrical lamp filter 8, which is arranged between the high pressure gas discharge lamp (GDL) 4 and the superimposed pulse starter 9 and has a filter capacitor (C1) in parallel to the high pressure gas discharge lamp (GDL) 4, and an inductor (L1, L2) in each of the feeder lines 13 to the parallel circuit.

The present invention is based on the concept of returning interference applied to a reflector 10 back to the starter 3 before it reaches the vehicle ground. To do so, a capacitor (C2) is arranged between the reflector 10 and one of the lamp power supply lines 7 at the input of the starter 3. For safety reasons, it is preferable to select the lamp power supply line having a lower potential with respect to the vehicle ground, which is to be measured during starting. Such a method of diverting interference will function only when an interference suppression filter is provided directly upstream from the high pressure gas discharge lamp 2, because otherwise the capacitor would apply the interference on the feedback line directly to the reflector 10 instead of diverting it. The filter capacitor C1 and inductors L1 and L2 form the interference suppression filter. The capacitor (C2) should be designed as a Y capacitor (Y capacitors are standardized radio interference suppression capacitors having an increased electrical and mechanical safety), because it should separate the lamp operating voltage from the reflector and should thus guarantee adequate shock protection.

It may be especially advantageous if one capacitor (C2, C3) is arranged between the reflector and each of the two lamp power supply lines 7 at the input of the starter circuit, because in this case no alternating current is fed to the reflector 10.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A circuit for operating an alternating current high pressure gas discharge lamp for a motor vehicle, comprising: a power supply unit, a starter circuit, a symmetrical lamp filter and a high pressure gas discharge lamp, which is at least partially surrounded by a reflector, the symmetrical lamp filter, being arranged between the high pressure gas discharge lamp and the starter circuit, having a filter capacitor arranged in parallel with the high pressure gas discharge lamp and an inductor arranged in the connecting lines between the high pressure gas discharge lamp and the starter circuit, and having two lamp power supply lines at the input of the starter circuit, wherein a capacitor is arranged between the reflector and one of the lamp power supply lines at the input of the starter circuit.

2. The circuit according to claim 1, wherein the capacitor is connected to the lamp power supply line which has a lower potential with respect to a vehicle chassis during starting of the lamp.

3. The circuit according to claim 1, wherein the capacitor is a Y capacitor.

4. The circuit according to claim 1, wherein the capacitor is arranged between the reflector and each of the two lamp power supply lines.

* * * * *